United States Patent [19]

Holleran et al.

[11] 4,126,728

[45] Nov. 21, 1978

[54] CERAMIC DECALCOMANIA

[75] Inventors: Louis M. Holleran, Elmira; Sylvester R. Sandor, Corning, both of N.Y.

[73] Assignee: Corning Glass Works, Corning, N.Y.

[21] Appl. No.: 823,987

[22] Filed: Aug. 12, 1977

[51] Int. Cl.[2] ..... B41M 3/12

[52] U.S. Cl. ..... 428/204; 428/206; 428/207; 428/210; 428/429; 428/914; 428/212

[58] Field of Search ..... 428/210, 212, 914, 40, 428/427, 428, 429, 204, 206, 207; 427/147, 148, 152, 203, 204, 193, 205, 376 R, 376 A, 376 P, 269, 279, 419 R, 419 E; 156/89

[56] References Cited

U.S. PATENT DOCUMENTS

| | | | |
|---|---|---|---|
| 1,852,759 | 4/1932 | Shaw et al. | 428/210 |
| 2,587,152 | 2/1952 | Harlan et al. | 427/376 A |
| 2,734,840 | 2/1956 | Kane | 156/89 |
| 3,857,746 | 12/1974 | Blanco | 156/89 |
| 3,898,362 | 8/1975 | Blanco | 428/914 |
| 3,956,558 | 5/1976 | Blanco | 428/428 |
| 4,038,448 | 7/1977 | Boyd et al. | 428/212 |
| 4,043,824 | 8/1977 | Wagar | 427/204 |

*Primary Examiner*—William A. Powell
*Assistant Examiner*—Michael W. Ball
*Attorney, Agent, or Firm*—Kees van der Sterre; Clinton S. Janes, Jr.; Clarence R. Patty, Jr.

[57] ABSTRACT

Ceramic decalcomania for the production of overglaze decorations on ceramic ware which include, in addition to the design layer, two separate layers of powdered glass acting in combination during firing to seal off corrosive glass-pigment interactions and provide fired decorations of improved detergent durability are described.

9 Claims, 2 Drawing Figures

CERAMIC DECALCOMANIA

BACKGROUND OF THE INVENTION

The present invention relates to ceramic decalcomania (decals) and particularly to improvements in decal structure which impart improved chemical durability to decorations on ceramic ware.

Overglaze decorations provided by firing fusible ceramic pigments onto previously glazed ceramic vessels such as cookware and dinnerware are repeatedly exposed to alkaline detergents in use. The need to protect such decorations from detergent attack has long been recognized; hence, present-day overglaze decorations often comprise a glass barrier layer over the pigment-containing design layer to protect the design from deterioration.

U.S. Pat. No. 2,734,840 to Kane, for example, describes a lithographic decal which includes a design layer consisting of a pigment pattern (the pigment being a ceramic pigment and including a minor amount of fusible fritted glass as a bonding agent), and a superimposed layer of a powdered, low-melting-point lead borosilicate glass. During firing, the powdered glass forms a protective layer over the non-durable pigments which is intended to protect the pigment from subsequent chemical attack.

As illustrated in U.S. Pat. No. 3,769,055 to Blanco, the manufacture of printed decals can also be accomplished by applying glass-free ceramic pigments to a decal base to form a design layer, and separately applying a layer of powdered lead borosilicate glass to the decal. On firing, this glass bonds the pigment to the ceramic article and acts to protect the pigment from subsequent damage.

U.S. Pat. No. 3,857,746 to Blanco et al. describes a ceramic decal produced by a four-color printing process wherein the colors are sequentially printed onto a decal base using mixtures of conventional ceramic pigments with a powdered CdO-containing lead silicate glass. The resulting design layer may optionally be covered with powdered CdO-containing glass for protection. Reportedly, this decal may be fired onto ceramic ware without the color deterioration normally accompanying the firing-on of multi-colored decorations.

In the manufacture of decalcomania for ceramic decorating, high concentrations of ceramic pigments such as CdS, CdS.Se, $Co_3O_4$ and the like are typically added to the pigment-frit mixtures used to form the decal design layer. High color concentrations are used in order to minimize color dilution and provide intensely colored designs. At the same time, the thickness of the decal must be limited to assure proper adherence between the fired decoration and the ceramic article. These demands for low thickness and saturated color tend to limit the amount of fusible glass material which can be incorporated into the decal for chemical and physical protection.

Presently available decals such as above described, comprising lead borosilicate glass for protection, do not always provide decorations exhibiting a satisfactory degree of resistance to attack by alkaline detergents. Moreover, although the lead and cadmium retention of the decoration may initially be satisfactory, deterioration from detergent attack typically leads to increased lead and cadmium release. Detergent durability appears to suffer most when cadmium-based colors such as, for example, CdS yellow or CdS.Se (cadmium sulfoselenide) red ceramic pigments are present in the design layer.

It is quite difficult to effect improvements in decoration durability simply by modifying the composition of the protective layer glass; the composition of this glass is largely dictated by the characteristics of presently available ceramic pigments. Hence, a CdO-containing glass is required in some cases in order to insure compatibility among the pigments at decal firing temperatures, and a low-melting-point glass is needed to avoid color deterioration which would result if high decal firing temperatures were employed.

In any event, presently utilized protective layer glasses, by themselves, exhibit adequate detergent durability, and there is no indication that the use of more durable glass would solve the present problem. Although very durable enamel glasses have recently been developed, as illustrated, for example, by the enamel glasses described in recently issued U.S. Pat. No. 4,038,448 to Boyd et al., there is no evidence that such glasses would be any more compatible with common decal pigments than presently available protective layer glasses.

It is a principal object of the present invention to provide a ceramic overglaze decalcomania of novel structure which produces decorations exhibiting improved detergent durability while retaining the advantages of design flexibility, vivid color and handling convenience offered by prior art decalcomania.

It is a further object of the invention to provide improvements in decal structure which result in improved decoration durability without the need to develop new, more stable ceramic pigment systems.

Other objects and advantages of the invention will become apparent from the following description.

SUMMARY OF THE INVENTION

The present invention is founded upon the discovery that the limited detergent durability of presently available decal decorations stems from interactions between the pigments in the design layer and the glass in the protective layer which occur during decal firing. These interactions are particularly severe when cadmium-containing ceramic pigments are present in the design layer. It is presently believed that these interactions affect the composition and/or structure of the fired glass protective layer, thereby lowering the detergent durability of the fired decoration.

In accordance with the present invention, significant improvements in decoration durability are realized by sealing off the interacting pigment and glass protective layer during firing, through the use of a second protective layer of glass. This additional layer, which is introduced as a second coating of powdered glass during the manufacture of the decal, should be composed of a glass which differs in composition from the glass of the first protective layer, and which has a lower softening point and preferably a lower viscosity at decal firing temperatures than the glass in the first protective layer. In addition, the glass forming the second protective layer must be one which itself exhibits good detergent durability.

In a specific embodiment, the invention first includes a ceramic color decalcomania which comprises a design layer containing at least one ceramic pigment, a first protective layer disposed on the design layer composed of a powdered low-melting-point glass, and a second protective layer disposed on the first protective layer which is composed of a powdered glass differing in composition from the glass of the first protective layer, having a softening point below that of the glass of the first protective layer and, preferably, having a viscosity below that of the glass of the first protective layer at temperatures in the firing range for the decal (typically 1000°-1500° F.). The low viscosity and particularly the low softening point of the glass of the second protective layer are important in inhibiting fluxing interactions between the second protective layer and the first protective layer and ceramic pigment. In this way the chemical durability of the second protective layer is preserved.

The invention further includes a decorated ceramic article having a decoration such as provided by the decalcomania above described, the decorated article supporting on at least a portion of the surface thereof a decoration comprising a design layer including at least one ceramic pigment, a first protective layer disposed on the design layer composed of a fused low-melting-point glass, and a second protective layer disposed on the first protective layer composed of a fused glass which differs in composition from the low-melting-point glass of the first protective layer, has a softening point lower than that of the low-melting-point glass of the first protective layer, and exhibits good detergent durability.

Decorations produced from decalcomania in accordance with the invention exhibit consistently high detergent durability, and therefore very low lead and cadmium release over a long term, in contrast to decals and decorations proposed in the prior art. For example, in one case where a decoration including a cadmium-containing pigment and a cadmium and lead-containing low-melting-point glass in the first protective layer has been employed, an improvement in detergent durability by more than a factor of 2 is obtained through the use of a second protective layer of soft, durable glass provided in accordance with the invention.

DESCRIPTION OF THE DRAWING

The invention may be further understood by reference to the drawing wherein.

Figure 1:
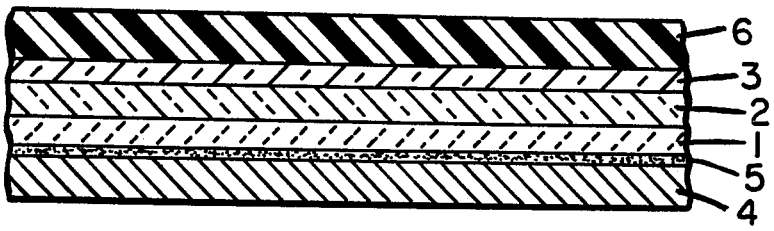
FIG. 1 is a partial elevational view in cross-section of one type of decalcomania within the scope of the present invention, including a design layer 1 covered by a first protective layer 2 consisting of powdered low-melting-point glass. Disposed on first protective layer 2 is a second protective layer 3 which is composed of powdered glass having a lower softening point than the glass of the first protective layer and good detergent durability.

The decalcomania illustrated in FIG. 1 is of the water-slide-off type, and includes further features conventional for such decals. Such features include a backing consisting of a paper sheet 4 covered with a water-soluble gum or adhesive 5, upon which the design layer 1 and first and second protective layers 2 and 3 are disposed, the design layer being positioned adjacent to the adhesive. The decalcomania further includes a lacquer coating 6 disposed upon and covering the second protective layer 3 which protects the decal during shipping, storage, and the various application steps prior to firing.

Figure 2:
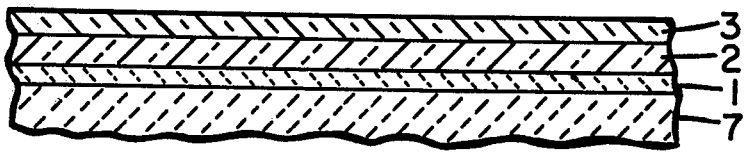

FIG. 2 consists of a partial elevational view in cross-section of a decorated ceramic article provided in accordance with the invention, illustrating the structure of the decoration resulting when a decalcomania having a configuration such as illustrated in FIG. 1 is fired onto a ceramic article. The design layer 1 containing at least one ceramic pigment is disposed on the surface of the ceramic article 7 and is covered by the first protective layer 2 composed of a fused low-melting point glass. Disposed on the first protective layer 2 is the second protective layer 3 consisting of durable fused glass having a composition differing from and a softening point lower than that of the fused glass forming the first protective layer. The fused glass of the second protective layer possesses good detergent durability and exhibits excellent long-term retention of lead and cadmium.

DETAILED DESCRIPTION

The manufacture of a decalcomania in accordance with the invention may be carried out using well-known decal fabrication techniques such as have been utilized in the prior art for this purpose. For example, where a water-slide-off decal is to be provided, a backing consisting of paper sheet upon which has been deposited a coating or layer of a water-soluble gum or adhesive is customarily used as the base to which ceramic pigments are applied to form the design layer. The design layer may be formed by dusting, painting or screening pigments or pigment-vehicle suspensions of selected colors onto the backing, or by printing such suspensions on the backing utilizing a three or four-color lithographic printing process such as described, for example, in U.S. Pat. No. 3,857,746 to Blanco et al.

Any of the ceramic pigments employed in the prior art for the manufacture of decals may be used in providing the design layer, including but not being limited to CdS, ZnS, CdS.Se, $Co_3O_4$, $Cr_2O_3$, $Fe_3O_4$, FeO and the like. As is well known, such pigments may be utilized in pure form or they may be mixed with fritted low-melting-point glass which serves as a pigment binder and bonding agent for the decoration after firing.

After the design layer has been deposited on the decal backing, the first protective layer of the decal is deposited on the design layer as a covering coating of powdered low-melting-point glass. This glass may be deposited, for example, by dusting onto the decal as a powder after the design layer has been coated with an adhesive gum or varnish. Alternatively, a powder-vehicle suspension may be screened or printed onto the design layer to form a continuous covering layer thereon. Vehicle formulations suitable for providing both pigment-containing suspensions and suspensions of powdered low-melting-point glass are well known in the art.

The composition of the powdered low-melting-point glass selected for use in forming the first protective layer (and as a pigment binder, if desired) will depend upon the pigment selected for use in the design layer. By low-melting-point glass is meant a glass which will sinter from a powder to form a fused glass at temperatures not exceeding about 1500° F. At temperatures above about 1500° F., some pigment breakdown and color deterioration may begin to occur.

In many cases, a simple ternary lead borosilicate glass is suitable for use in the design layer and to provide the first protective layer; however, as is well known, it may be desirable to use a cadmium-containing lead borosilicate glass when the design layer includes at least one cadmium-containing ceramic pigment, in order to stabilize the color of this pigment at decal firing temperatures. Both types of glasses have been used in the prior art.

The application of the second protective layer as a coating of powdered glass covering the first protective layer may be accomplished by any of the conventional dusting, painting, or screen or direct printing techniques. However, the composition of the glass used to form this second layer must differ from that of the first protective layer glass, since a lower softening point and, preferably, a lower viscosity at elevated decal firing temperatures are required. The composition of the glass used to form the second layer is thus important since it affects the softening point, viscosity and detergent durability of the final protective layer.

We have found that certain lead borosilicate glasses selected from the $PbO—B_2O_3—SiO_2—Li_2O—TiO_2—ZrO_2$ composition system, particularly the enamel flux glasses described in the aforementioned U.S. Pat. No. 4,038,448 to Boyd et al., produce excellent results when utilized in powder form to provide the second protective layer of the decal. Such glasses possess good detergent durability, and exhibit softening at temperatures not exceeding about 615° C. which permits firing to provide a glassy protective layer at temperatures below about 720° C.

Specific compositions within the $PbO—B_2O_3—SiO_2—Li_2O—TiO_2—ZrO_2$ composition system which may be used to form the second protective layer include those consisting essentially, in weight percent, of about 45-55% PbO, 4-8% $B_2O_3$, 28-38% $SiO_2$, 0.5-3% $Li_2O$, 1-5% $TiO_2$ and 3-8% $ZrO_2$. Optional additions of, for example, about 0-4% CdO, 0-3% ZnO, 0-3% $Al_2O_3$, 0-3%, $Y_2O_3$, 0-4% $Ta_2O_5$, and 0-2% $SnO_2$, as well as minor amounts of other ingredients, may also be included in the composition, although the total of all such optional additions is preferably held to a level not exceeding about 8% of the composition. It will of course be recognized that, while compositions selected from this field have demonstrated excellent performance when utilized according to the invention as above described, other glass compositions exhibiting suitably low softening points and good detergent durability may alternatively be employed.

The invention may be further understood by reference to the following example illustrating the manufacture of a decal and the testing of a decoration provided therefrom in accordance with the invention.

EXAMPLE

A ceramic overglaze decal of the water-slide-off type, having a structure and composition conventional for such decals, is first provided. This decal was produced by applying to a decal paper backing comprising paper sheet and a water soluble gum coating a series of ceramic pigments, including at least one pigment containing a cadmium constituent, to form a decal design layer on the backing. Following the application of the design layer to the backing, a first protective layer composed of a powdered low-melting-point glass, having a composition which is conventional and which includes PbO, $B_2O_3$, $SiO_2$ and CdO, was applied to the design layer. The powdered glass was applied in a thickness sufficient to provide a protective layer about 6 microns in thickness after firing.

A second protective layer consisting of powdered $PbO—B_2O_3—SiO_2—Li_2O—TiO_2—ZrO_2$ glass, having a composition consisting of about 50 parts PbO, 5 parts $B_2O_3$, 33 parts $SiO_2$, 1.1 parts $Li_2O$, 2.1 parts $TiO_2$, 6.4 parts $ZrO_2$ and 1.2 parts CdO by weight, is applied to the first protective layer of the decal. This second layer is applied by printing a suspension of the powdered glass onto the first protective layer in a thickness sufficient to provide a second protective layer about 3 microns thick after firing. The suspension used for printing consists of about 70 parts powdered glass and 30 parts of a vehicle by weight, the powdered glass in the suspension having a particle size of about 2 microns.

Following the application of the second protective layer and drying, a final layer of decal carrying lacquer is applied to the decal by printing, and allowed to dry.

A ceramic vessel is selected for decoration and the decal design is applied thereto by soaking the decal in water and then sliding the combined design layer, protective layers and supporting lacquer film from the backing paper onto the vessel. The vessel with adhering decal layers is then fired in a decorating kiln to a peak temperature of 810° C., cooled to room temperature, and examined. The fired decoration exhibits both excellent gloss and bright coloration.

The decorated ceramic vessel produced as described is then subjected to detergent durability testing along with a similar vessel bearing a decoration provided utilizing a prior art decal. The prior art decal is a water-slide-off decal comprising a backing, a design layer, a first protective layer, and a lacquer layer, all of these layers being identical in composition and thickness to the corresponding layers of the inventive decal just described. However, no second protective layer of powdered $PbO—B_2O_3—SiO_2—Li_2O—TiO_2—ZrO_2$ glass is provided. This prior art decal is applied and fired onto its supporting ceramic vessel using the same firing treatment which was employed in firing on the decoration of the invention in the manner above described.

The detergent test used to compare the durability of the two decorations comprises immersing the decorated vessels into a hot (95° C.) aqueous detergent solution which contains 0.3% by weight of Super Soilax® detergent, a detergent commercially available from Economics Laboratories, St. Paul, Minnesota. At 24 hour intervals the vessels are removed from the hot detergent solution, examined to determine the extent of attack, and returned to the solution. At the end of 96 hours the test is terminated.

The durability of each decoration is rated on a scale of 0-12, based on degree of detergent attack as manifested by the appearance, porosity, and adherence of the decoration. A rating of 0 is excellent, corresponding to the absence of visible or measurable attack, while a rating above 6 is deemed to be commercially unacceptable.

The results of detergent tests on the two decorated vessels of the Example are set forth in Table I below:

TABLE I

| | Detergent Test | |
|---|---|---|
| | Ratings - Prior Art Decoration | Ratings - Novel Decoration |
| After 24 hours | 2 | 0 |
| After 48 hours | 4.5 | 2 |
| After 72 hours | 6 | 3 |
| After 96 hours | 6 | 3 |

From the above results and the additional results of similar detergent tests, it appears that detergent durability ratings of 3 and below after 96 hours are readily obtained with any of the commonly used ceramic pigments using decals provided in accordance with the invention. Such ratings are at least equivalent to and usually significantly better than the detergent durability ratings exhibited by conventional decals, particularly, for example, in cases where cadmium-containing pigments are used in the decal.

The excellent durability of decorations provided in accordance with the invention is not due simply to the use of a very durable glass for the second protective layer. To the contrary, detergent durability data suggest that two different protective layers, having properties and compositions differing from each other as specified herein, must be used to provide high durability when highly reactive pigment systems are to be used. Hence, the data indicate that no improvement in durability is realized using a decal wherein a highly durable $PbO—B_2O_3—SiO_2—Li_2O—TiO_2—ZrO_2$ protective layer is simply substituted for the low-melting-point $PbO—B_2O_3—SiO_2—CdO$ protective layer of the decal of the prior art.

The durability data set forth in Table II below are obtained by detergent-testing a decoration provided from a water-slide-off decal comprising a backing, a design layer containing a cadmium-containing pigment, a single six-micron-thick protective layer composed of durable $PbO—B_2O_3—SiO_2—Li_2O—TiO_2—ZrO_2$ glass, and a lacquer coating. The backing and the design layer of the decal are identical in composition and structure to the decals described in the above Example, and a $PbO—B_2O_3—SiO_2—Li_2O—ZrO_2$ glass having the same composition is used for the protective layer. The firing procedure employed in the Example is also used to fire this decoration onto the ceramic article.

TABLE II

| | Detergent Test |
|---|---|
| | Ratings - Durable Glass Decoration |
| After 24 hours | 2.5 |
| After 48 hours | 3 |
| After 72 hours | 4.5 |
| After 96 hours | 7.5 |

From data such as shown in Table II we have concluded that decoration durability is not significantly improved merely by changing the composition of the protective layer glass as shown. We attribute this result to pigment-protective layer interactions which tend to degrade decoration durability regardless of protective layer composition. Thus the effectiveness of our multiple-layer method for sealing off the interacting materials to enhance decoration durability is demonstrated.

Of course, it will be recognized from the foregoing description that the present invention has applicability to the production of decal types other than water-slide-off decals of the kind specifically illustrated above. Thus, for example, a heat release decal comprising a design layer and first and second protective layers disposed upon a decal backing comprising paper sheet provided with a heat-release coating could readily be provided. It will thus be understood that the foregoing examples are merely illustrative of the invention and that numerous other embodiments thereof may be resorted to by the skilled artisan within the scope and spirit of the appended claims.

We claim:

1. An overglaze ceramic color decalcomania comprising:
   (a) a design layer including at least one ceramic pigment;
   (b) a first transparent protective layer disposed on the design layer composed of a powdered low-melting-point glass without color pigment;
   (c) a second transparent protective layer disposed on the first protective layer composed of a powdered glass without color pigment which (i) differs in composition from the glass of the first protective layer, (ii) has a softening point below that of the glass of the first protective layer; (iii) exhibits good detergent durability; said second protective layer acting to seal off interactions between said pigment and said first protective layer during firing and
   (d) a backing upon which are disposed the design layer, the first protective layer and the second protective layer.

2. A decalcomania in accordance with claim 1 wherein the design layer includes at least one cadmium-containing ceramic pigment.

3. A decalcomania in accordance with claim 2 wherein the first protective layer is composed of a powdered lead borosilicate glass.

4. A decalcomania in accordance with claim 3 wherein the powdered lead borosilicate glass contains cadmium oxide.

5. A decalcomania in accordance with claim 1 wherein the powdered glass forming the second protective layer has a lower viscosity than the powdered low-melting-point glass forming the first protective layer at temperatures in the firing range for the decalcomania.

6. A decalcomania in accordance with claim 1 wherein the backing comprises paper sheet coated with a water-soluble adhesive.

7. A decalcomania in accordance with claim 1 wherein the backing comprises paper sheet coated with a heat-release coating.

8. A decalcomania in accordance with claim 1 wherein the powdered glass forming the second protective layer is selected from the $PbO—B_2O_3—SiO_2—Li_2O—TiO_2—ZrO_2$ composition system.

9. A decalcomania in accordance with claim 1 wherein the powdered glass forming the second protective layer has a composition consisting essentially, in weight percent, of about 45–55% PbO, 4–8% $B_2O_3$, 28–38% $SiO_2$, 0.5–3% $Li_2O$, 1–5% $TiO_2$, 3–8% $ZrO_2$, 0–4% CdO, 0–3% ZnO, 0–3% $Al_2O_3$, 0–3% $Y_2O_3$, 0–4% $Ta_2O_5$, 0–2% $SnO_2$, and 0–8% total of CdO, ZnO, $Al_2O_3$, $Y_2O_3$, $Ta_2O_5$ and $SnO_2$.

* * * * *